US008866389B2

(12) United States Patent
Okino et al.

(10) Patent No.: US 8,866,389 B2
(45) Date of Patent: Oct. 21, 2014

(54) PLASMA TEMPERATURE CONTROL APPARATUS AND PLASMA TEMPERATURE CONTROL METHOD

(76) Inventors: Akitoshi Okino, Yokohama (JP); Hidekazu Miyahara, Katsushika-ku (JP)

( * ) Notice: Subject to any disclaimer, the term of this patent is extended or adjusted under 35 U.S.C. 154(b) by 624 days.

(21) Appl. No.: 13/061,926

(22) PCT Filed: Sep. 3, 2009

(86) PCT No.: PCT/JP2009/065394
§ 371 (c)(1),
(2), (4) Date: Mar. 2, 2011

(87) PCT Pub. No.: WO2010/027013
PCT Pub. Date: Mar. 11, 2010

(65) Prior Publication Data

US 2011/0156590 A1 Jun. 30, 2011

(30) Foreign Application Priority Data

Sep. 3, 2008 (JP) ..... 2008-225485

(51) Int. Cl.
*H05H 1/00* (2006.01)
*H05H 1/24* (2006.01)
*H05H 1/46* (2006.01)

(52) U.S. Cl.
CPC ..... *H05H 1/24* (2013.01); *H05H 1/0006* (2013.01); *H05H 1/46* (2013.01)
USPC ..... 315/111.21; 315/11; 156/345.47; 118/726

(58) Field of Classification Search
USPC ..... 315/111.21, 111.01; 156/345.27, 156/245.29; 118/715, 50, 723 E, 723 R
See application file for complete search history.

(56) References Cited

U.S. PATENT DOCUMENTS

| | | | | |
|---|---|---|---|---|
| 6,811,651 | B2 * | 11/2004 | Long | 156/345.27 |
| 7,218,382 | B2 * | 5/2007 | Kasumi | 355/72 |
| 7,347,006 | B2 * | 3/2008 | Moriya et al. | 34/403 |
| 7,531,061 | B2 * | 5/2009 | Long | 156/345.27 |
| 8,216,486 | B2 * | 7/2012 | Dhindsa et al. | 216/67 |
| 8,465,593 | B2 * | 6/2013 | Hayashi et al. | 118/726 |

(Continued)

FOREIGN PATENT DOCUMENTS

| | | |
|---|---|---|
| JP | H08-181111 A | 7/1996 |
| JP | H09-057092 A | 3/1997 |

(Continued)

OTHER PUBLICATIONS

"Toxicity of Non-Thermal Plasma Treatment of Endothelial Cells" by Sameer Kalghatgi et al. at 35th IEEE International Conference on Plasma Science of Jun. 16, 2008, p. 210.

(Continued)

*Primary Examiner* — Douglas W Owens
*Assistant Examiner* — Srinivas Sathiraju
(74) *Attorney, Agent, or Firm* — DLA Piper LLP (US)

(57) ABSTRACT

The plasma temperature control apparatus includes a plasma generating section 40 that turns a plasma-generating gas into plasma, and a plasma-generating gas temperature control section 30 that controls the temperature of the plasma-generating gas supplied to the plasma generating section 40. The temperature of the plasma generated in the plasma generating section 40 is controlled by controlling the temperature of the plasma-generating gas.

6 Claims, 6 Drawing Sheets

(56) References Cited

U.S. PATENT DOCUMENTS

| | | | | |
|---|---|---|---|---|
| 8,485,127 | B2 * | 7/2013 | Nishimoto et al. | 118/723 MW |
| 8,647,585 | B2 * | 2/2014 | Hancock | 422/186 |
| 2005/0236109 | A1 * | 10/2005 | Masuda et al. | 156/345.27 |
| 2009/0111276 | A1 * | 4/2009 | Dhindsa et al. | 438/710 |

FOREIGN PATENT DOCUMENTS

| | | | |
|---|---|---|---|
| JP | H11-067732 | A | 3/1999 |
| JP | 2003-203904 | A | 7/2003 |
| JP | 2007-227068 | A | 9/2007 |
| JP | 2007-227297 | A | 9/2007 |
| WO | WO 2005/065805 | A | 1/2005 |

OTHER PUBLICATIONS

"Micro-/Nano-Plasma Technology and Industrial Applications" written by Kunihide Tachibana et al. and published on Dec. 27, 2006 by CMC Press in Japan, pp. 69-81.

* cited by examiner

PLASMA TEMPERATURE CONTROL APPARATUS AND PLASMA TEMPERATURE CONTROL METHOD

TECHNICAL FIELD

The present invention relates to a plasma temperature control apparatus for controlling the temperature of plasma, and a plasma temperature control method.

BACKGROUND ART

Conventionally, the temperature of plasma has been thought to be roughly determined by the type of gas generating the plasma, the flow rate of gas, the quantity of energy applied, the method of generating the plasma, the atmosphere in a plasma generating chamber, and the like.

However, from the perspective of application to various fields, enabling the temperature of plasma to be controlled over a wider temperature range is being demanded. For example, in surface treatments using a conventional plasma apparatus, reaction speeds and treatment results are controlled through control of the temperature of the object to be treated (such as a substrate when treating a semiconductor). However, when methods in which the temperature of the object to be treated is controlled are used, a problem occurs in that the objects that can be treated and the like become limited.

In particular, there has recently been demand for lower plasma temperatures. Therefore, some attempts at lowering the temperature of plasma have been made by reducing energy supplied to plasma gas by increasing the flow rate of gas injected into the plasma in relation to energy supplied to the plasma generating chamber. Alternatively, the quantity of energy injected into the plasma is reduced. However, significant temperature reduction could not be achieved.

For example, reduction of the temperature of plasma has been attempted by using pulsed power supply and intermittently supplying the plasma with electric power, thereby reducing the total quantity of energy added to the plasma (to a very small quantity of 0.2 W to 3 W), when generating the plasma. In addition, an attempt has been made in which a discharge electrode is cooled. However, this attempt too aims to suppress "temperature rise" in the electrode and the plasma (refer to Non-patent Literature 1).

Furthermore, to lower the temperature of plasma, helium gas having high heat conductivity is used as plasma gas, heat generated in the plasma is released by being transmitted to the gas, electric power required for plasma generation is minimized, and power supply to the plasma is intermittently performed, thereby reducing the quantity of energy added to the plasma as a total (refer to pages 235, 236, and 245 of Non-patent Literature 2).

Moreover, attempts have been made to "not increase the plasma temperature at all" by pulse operation, power reduction, and increased flow rate of gas. However, these attempts all suppress temperature rise by "the temperature of the gas to be supplied".

Non-patent Literature 1: The 35th IEEE International Conference on Plasma Science (ICOPS 2008) Oral Session 1E on Monday, June. 16, 09:30-12:00 Conference Abstracts, 2D4 TOXICITY OF NON-THERMAL PLASMA TREATMENT OF ENDOTHELIAL CELLS Non-patent Literature 2: Micro-/Nano-Plasma Technology and industrial Applications, CMC Press, Dec. 27, 2006

DISCLOSURE OF INVENTION

Problem to be Solved by the Invention

Although attempts have been made to achieve reduction in plasma temperature in this way, none of the attempts are able to actualize significant temperature reduction.

Furthermore, conventionally, in the technical field of plasma, although controlling the temperature of plasma is imperative, a technical idea of controlling the temperature of plasma by controlling the temperature of plasma-generating gas before being turning into plasma had never been conceived and was unexpected. In particular, the idea of reducing the temperature of "the gas to be supplied" had not existed in the past. Moreover, in vapor phase synthesis using a conventional plasma apparatus, the temperature of plasma could only be controlled through control of electric power applied to the plasma and the flow rate of gas.

Therefore, in light of the above-described issues, an object of the present invention is to provide a plasma temperature control apparatus and a plasma temperature control method, in which plasma at room temperature or below, particularly below zero, can be generated and plasma temperature can be more accurately controlled over a wide temperature range, from low temperatures to high temperatures.

Means for Solving Problem

To solve the above-described issues, a plasma temperature control apparatus according to a first aspect of the present invention includes: a plasma generating section that turns a plasma-generating gas into plasma; and a plasma-generating gas temperature control section that controls the temperature of the plasma-generating gas supplied to the plasma generating section. A temperature of a gas in the plasma generated in the plasma generating section is controlled by controlling the temperature of the plasma-generating gas.

The above-described "temperature of the plasma" and "plasma temperature" refer to the kinetic temperature of atoms or molecules forming the plasma, namely the temperatures of translation, rotation, and vibration (referred to hereinafter as gas temperature, whereas the kinetic temperature of electrons is referred to as electron temperature), in a non-thermal equilibrium state.

The plasma temperature control apparatus according to a second aspect is the plasma temperature control apparatus according to the first aspect, in which the plasma-generating gas temperature control section controls the temperature of the plasma-generating to be higher or lower than room temperature.

The plasma temperature control apparatus according to a third aspect is the plasma temperature control apparatus according to the first or second aspect, in which the plasma-generating gas temperature control section controls the temperature of the plasma-generating gas to a temperature lower than room temperature, and makes the temperature of the plasma generated in the plasma generating section a temperature lower than room temperature.

The plasma temperature control apparatus according to a fourth aspect is the plasma temperature control apparatus according to the first or second aspect, in which the plasma-generating gas temperature control section includes a plasma-generating gas cooling section and heating section. The temperature of the plasma-generating gas is controlled by the cooling section cooling the plasma-generating gas and the heating section heating the cooled plasma-generating gas.

The plasma temperature control apparatus according to a fifth aspect is the plasma temperature control apparatus according to the first or second aspect, the plasma temperature control apparatus including a temperature measuring section that measures the temperature of the plasma. The temperature of the plasma-generating gas is controlled by feeding back the plasma temperature measured by the temperature measuring section to the plasma-generating gas temperature control section.

A plasma temperature control method according to a sixth aspect is a plasma temperature control method that controls a temperature of a gas in the plasma, in which the temperature of the gas in the plasma is controlled to an arbitrary temperature by controlling the temperature of a plasma-generating gas for the plasma.

In the plasma temperature control apparatus and the plasma temperature control method of the present invention, significant reduction and rise in the plasma temperature is achieved by the temperature of the plasma-generating gas being controlled to be higher or lower than room temperature. The plasma temperature can be more accurately controlled over a wide temperature range, from low temperatures to high temperatures.

In addition, in the plasma temperature control apparatus of the present invention, the plasma temperature control section is provided with the plasma-gas cooling section and heating section. As a result of the temperature of the plasma-generating gas being controlled through cooperation between the cooling section and the heating section, the temperature of the plasma-generating gas can be accurately controlled with comparative ease. Furthermore, the plasma temperature can be precisely controlled by the plasma temperature measuring section measuring the plasma temperature and applying feedback to the plasma temperature control section.

Effect of the Invention

According to the plasma temperature control apparatus and the plasma temperature control method of the present invention, significant reduction in plasma temperature can be achieved, and plasma at room temperature or below, particularly below zero, can be generated. In addition, the plasma temperature can be more accurately controlled over a wide temperature range, from low temperatures to high temperatures.

EXPLANATIONS OF LETTERS OR NUMERALS

Best Mode(s) for Carrying out the Invention

A plasma temperature control apparatus of the present invention is capable of arbitrarily controlling the temperature of plasma by adjusting the temperature of a plasma-generating gas using a plasma-generated gas temperature control section. For example, as a result of the temperature of the plasma-generating gas being adjusted, a plasma temperature of 0° C. or below, and furthermore, a temperature of plasma that is near the boiling point of the substance used as the plasma-generating gas (for example, a temperature that is the absolute temperature of 10K or below, when helium gas is used as the plasma-generating gas) can be achieved. The plasma temperature control apparatus includes a plasma generating section that turns a plasma-generating gas into plasma, a plasma-generating gas temperature control section that controls the temperature of the plasma-generating gas supplied to the plasma generating section, and the like. The plasma-generating gas is a gas before being turned into plasma and gas generated as plasma, also generally referred to as a plasma gas. The plasma-generating gas temperature control section can control the plasma-generating gas to be above or below room temperature, and may be any component as long as it is capable of controlling the temperature of the plasma-generating gas. As the plasma-generating gas, in addition to noble gas such as argon or helium, various gases such as oxygen, hydrogen, nitrogen, methane, chlorofluorocarbon, air, and water vapor, or a mixture thereof and the like can be applied. Plasma may be in a largely ionized state, may have mostly neutral particles with some in an ionized state, or may be in an excitation state. The plasma temperature control apparatus can be applied to a wide range of fields, such as diamond-like carbon (DLC) thin-film generation, plasma Processing, plasma chemical vapor deposition (CVD), trace elements analysis, nano-particles generation, plasma light sources, plasma arc machining, gas treatment, and plasma disinfection.

Figure 1:
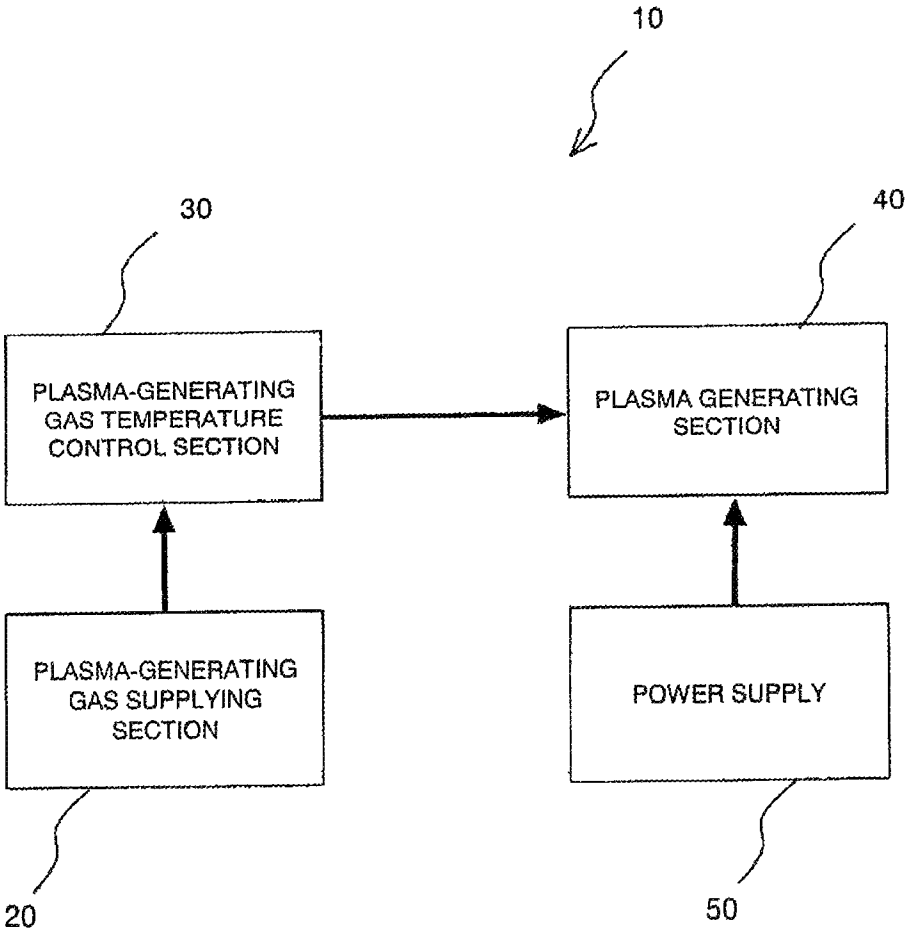
FIG. 1 is a block diagram of a plasma temperature control apparatus according to an embodiment of the present invention.

FIG. 1 is a block diagram of a plasma temperature control apparatus 10 according to an embodiment of the present invention. The plasma temperature control apparatus 10 according to the present embodiment includes a plasma-generating gas supplying section 20, a plasma-generating gas temperature control section 30, a plasma generating section 40, a power supply 50, and the like. The plasma generating section 40 may have any structure and be based on any principle, as long as it is capable of turning the plasma-generating gas into plasma. For example, various methods and means can be used, such as an inductively coupled plasma method, a microwave plasma method using a cavity resonator or the like, and an electrode method such as parallel plates or coaxial-type. As the power supply 50 used to generate plasma, various modes can be used, from direct current to alternating current, high-frequency waves, microwaves or more. In addition, plasma may be generated by injection of light such as laser, shock waves, or the like from outside. The plasma generating section 40 may generate plasma by combusting combustible gas, combustible liquid, combustible solid, and the like. Furthermore, the plasma generating section 40 may generate plasma by combining the plurality of methods and means. According to the present embodiment and an embodiment described hereafter, a plasma generating device for use under atmospheric pressure is used as the plasma generating section 40, and plasma generation is performed under atmospheric pressure.

Figure 2:
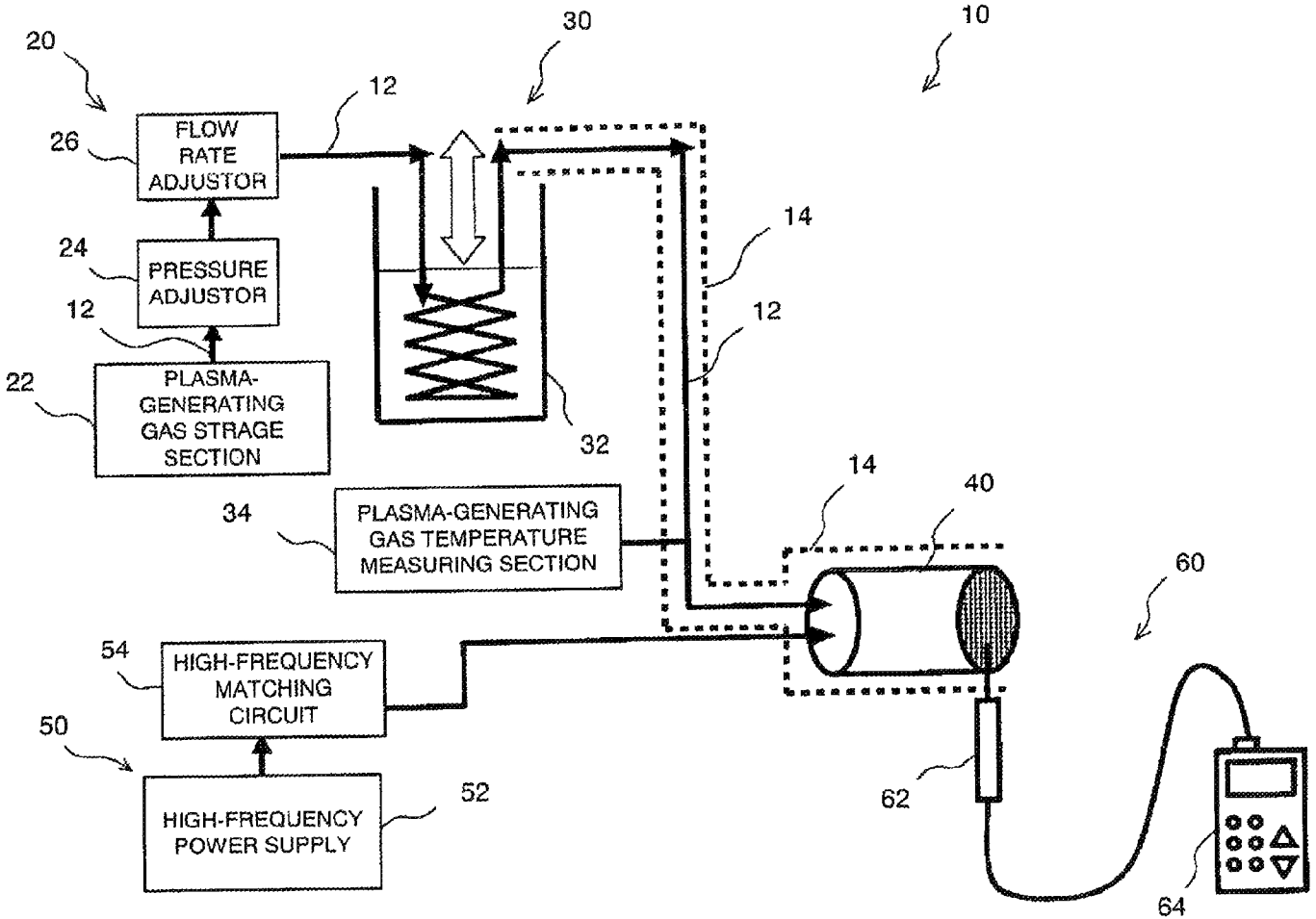
FIG. 2 is an overall schematic diagram of the plasma temperature control apparatus in FIG. 1.

FIG. 2 is an overall schematic diagram of the plasma temperature control apparatus 10 in FIG. 1. As the plasma generating section 40, an atmospheric pressure, high-frequency, non-equilibrium plasma generating device that is a parallel-plate-type/capacitive-coupling-type plasma generating device, or the like is used. The plasma generating section 40 is operated under ordinary plasma generating conditions. A high-frequency power supply 52 is used as the power supply 50 supplying electric power to the plasma generating section 40. A high-frequency matching circuit 54 is disposed to perform matching with the plasma generating section 40. In this way, the high-frequency power supply 52 supplies electric power to the plasma generating section 40.

The plasma-generating gas temperature control section 30 sends the plasma-generating gas via a gas pipe 12 through a cooler 32 that uses liquid nitrogen, cools the plasma-generating gas, and injects the cooled plasma-generating gas into the plasma generating section 40. In the cooler 32, liquid nitrogen is placed in a container. The gas pipe 12 for the plasma-generating gas is placed into and taken out of the container, thereby adjusting the temperature. The plasma-generating gas is sent via the gas pipe 12 from a plasma-generating gas storage section 22 to the cooler 32, passing through a pressure adjustor 24 and a flow rate adjustor 26. The temperature of the plasma-generating gas is measured as required by a plasma-generating gas temperature measuring section 34 in the gas pipe 12 immediately before the plasma generating section 40. To suppress changes such as increase in the temperature of the plasma-generating gas from occurring again after gas cooling, a heat insulating material 14 is disposed in the periphery or within the gas pipe 12, the plasma generating section 40, and the like. As the heat insulating material 14, cotton, asbestos, foamed polystyrene, sponge, polyester, foamed rubber, foamed urethane, gas such as dry air, insulating gas such as $SF_6$, epoxy, acrylic, oil, paraffin, or the like can be used. When a liquid or a gas is used as the heat insulating material 14, the heat insulating material 14 may be constantly circulated. To quickly control the temperature of the plasma-generating gas to an arbitrary temperature, according to the present embodiment, the gas pipe 12 and the plasma generating section 40 may be cooled or temperature-adjusted in advance.

The temperature of plasma is measured by a plasma temperature measuring section 60. The plasma temperature measuring section 60 measures the temperature of plasma (gas temperature Tg) by a thermocouple 62 being set at a plasma ejection outlet of the plasma generating section 40. At this time, to accurately measure the temperature of plasma, the thermocouple 62 is surrounded by aluminum tape (not shown) and external disturbance is suppressed. To prevent the temperature of the plasma generating section 40 from being measured, the aluminum tape is bent such that a temperature sensing section of the thermocouple 62 does not come into contact with the plasma generating section 40. The plasma temperature measured by the plasma temperature measuring section 60 is displayed in a temperature displaying section 64.

Next, an experiment to check whether or not the plasma temperature can be controlled using the above-described plasma temperature control apparatus 10 according to the present embodiment will be described. The experiment was conducted for the purpose of checking whether the temperature of the plasma can be controlled by controlling the plasma-generating gas injected into the plasma generating section 40. Specifically, in the plasma temperature control apparatus 10 shown in FIG. 2, the plasma-generating gas passes via the gas pipe 12 through the cooler 32 filled with liquid nitrogen and is sufficiently cooled. Then, the cooled plasma-generating gas is injected into the plasma generating section 40. The plasma temperatures before and after the cooled plasma-generating gas is injected are measured at a constant time interval, and the changes over time are checked.

Figure 3:
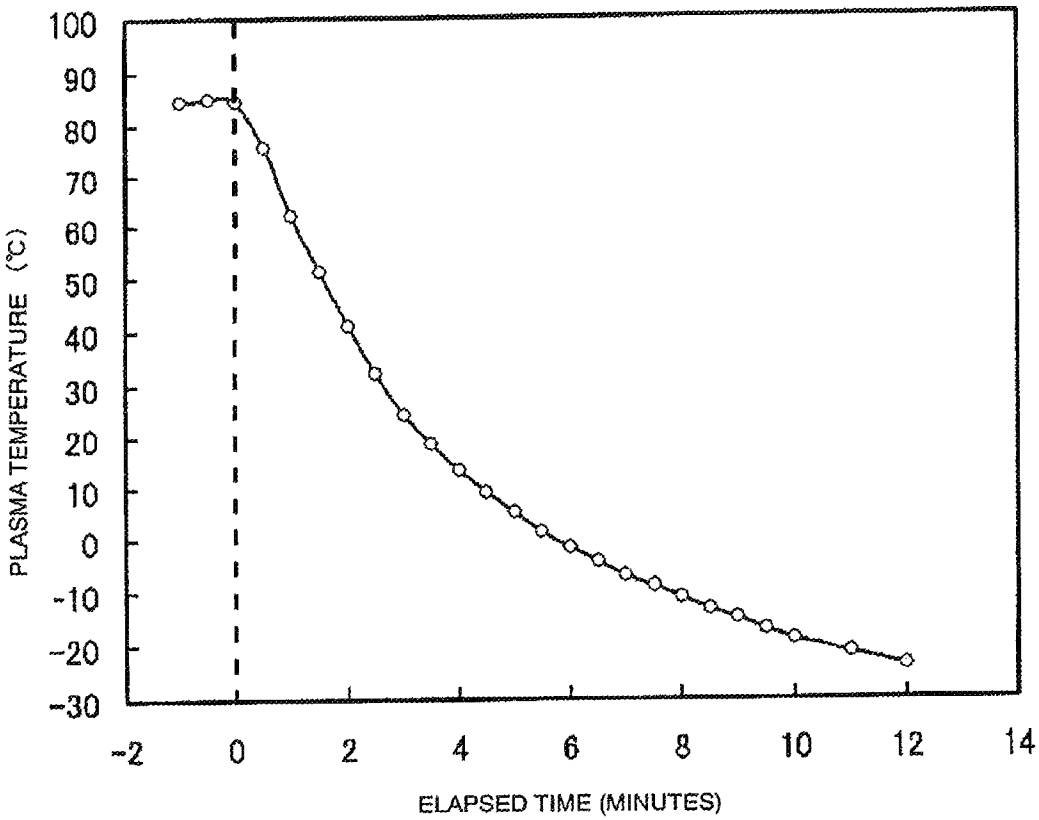
FIG. 3 is a graph showing a relationship between plasma temperature and time before and after the start of cooling in the plasma temperature control apparatus in FIG. 2.

FIG. 3 shows a relationship between plasma temperature and time before and after the start of cooling when the atmospheric pressure, high-frequency, non-equilibrium plasma generating device is used as the plasma generating section 40, helium gas is used as the plasma-generating gas, the temperature and the flow rate thereof are respectively −163° C. and 15 liters (L)/minute, and the power supply 50 supplies RF power of 60 W. Point zero on the horizontal axis in FIG. 3 indicates the time at which the cooled plasma-generating gas is injected into the plasma generating section 40, or in other words, the start of cooling of the plasma. The standard plasma temperature of the helium plasma generated by the atmospheric pressure, high-frequency, non-equilibrium plasma generating device is 80° C. to 100° C. The plasma temperature becomes 40° C. from 80° C. two minutes after the start of cooling, becomes −10° C. after eight minutes, and becomes about −23.7° C. after twelve minutes.

Figure 4:
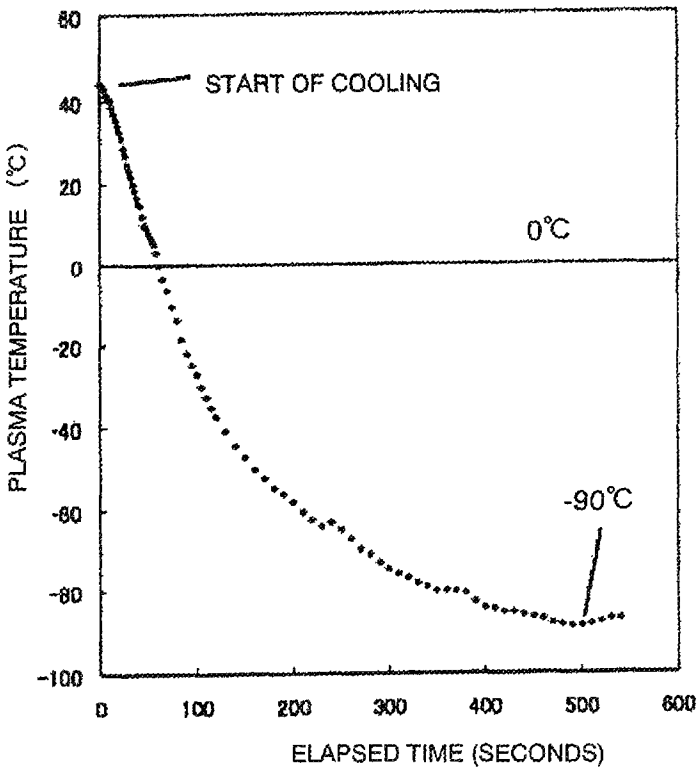
FIG. 4 is a graph showing a relationship between plasma temperature and time after the start of cooling in the plasma temperature control apparatus in FIG. 2.

In addition, FIG. 4 shows a relationship between plasma temperature and time after the start of cooling when a dielectric-barrier discharge-type, atmospheric pressure plasma jet is used as the plasma generating section 40, helium gas is used as the plasma-generating gas, the temperature and the flow rate thereof are respectively about −170° C. and 10 liters (L)/minute, and the power supply 50 supplies alternating current power of 90 kV and 73 W. As shown in FIG. 4, the plasma temperature that is about 44° C. at the start of cooling drops to about −90° C. after about eight minutes from the start of cooling.

FIG. 3 and FIG. 4 clearly show that, as a result of the temperature of the plasma-generating gas being changed in this way, the plasma temperature can be controlled. Even when the plasma-generating gas temperature is changed, the plasma does not become unstable at least within a visual range, and a phenomenon in which the plasma is extinguished could not be observed.

In the experiment shown in FIG. 3, regarding helium plasma generated by the plasma generating section 40, as a result of the plasma-generating gas supplied to the plasma generating section 40 being cooled to −163° C., a low-temperature plasma of −23.7° C. can be generated. In the experiment shown in FIG. 4, as a result of the plasma-generating gas being cooled to about −170° C., a low-temperature plasma of about −90° C. can be generated. It is thought that time of a number of minutes is required for the plasma temperature to drop because the time is mainly used to cool the gas pipe 12. The present method indicates that the temperature of plasma can be controlled by controlling the temperature of the plasma-generating gas.

According to the embodiment of the present invention, all that is required is to control the temperature of the plasma-generating gas. Therefore, in the plasma generating section 40 in which an electrode is present, the temperature of the plasma-generating gas may be controlled by controlling the temperature of the electrode.

Figure 5:
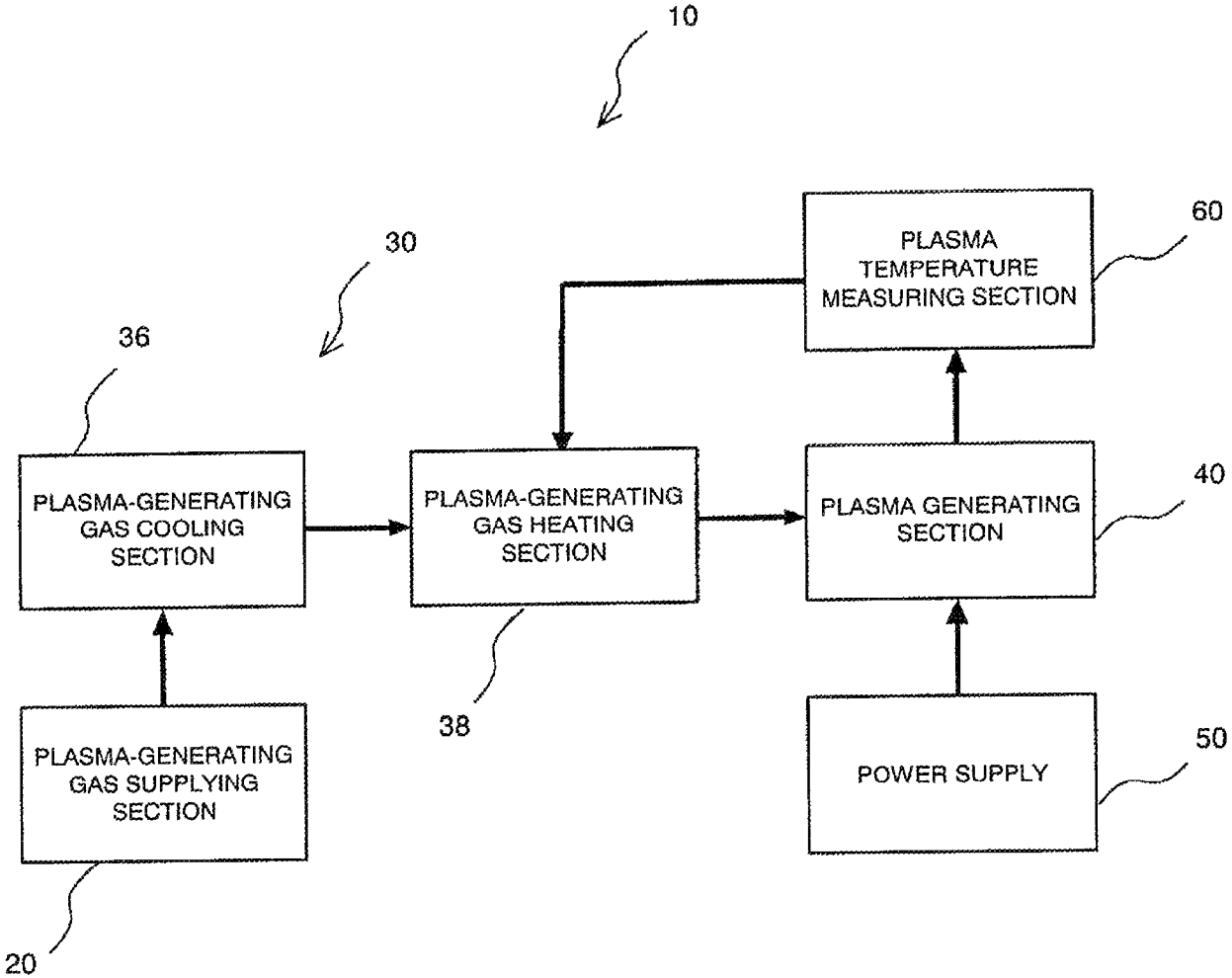
FIG. 5 is a block diagram of a plasma temperature control apparatus according to another embodiment.

FIG. 5 is a block diagram of the plasma temperature control apparatus 10 according to another embodiment. The plasma gas temperature control apparatus 30 according to the present embodiment includes a plasma-generating gas cooling section 36 for cooling the plasma-generating gas and a plasma-generating gas heating section 38 for heating the cooled plasma-generating gas. The temperature of the plasma-generating gas is first cooled by the plasma-generating gas cooling section 36 and then heated by the plasma-generating gas heating section 38 to be controlled to a predetermined temperature. As a result, the temperature of the plasma-generating gas can be accurately controlled with comparative ease.

The temperature of the plasma-generating gas can be used to precisely control the plasma temperature by the plasma temperature measuring section 60 measuring the plasma temperature and feeding back the measured plasma temperature to the plasma-generating gas temperature control section 30. When the plasma-generating gas temperature control section 30 has the plasma-generating gas heating section 30, feedback may be applied to the plasma-generating gas heating section 38, and the plasma-generating gas heating section 38 may be controlled. The plasma temperature can be controlled with further accuracy by heat capacity being reduced in the area in which the plasma-generating gas is supplied to the plasma generating section 40. According to the present embodiment, all that is required is for the plasma temperature measuring section 60 to measure a specific temperature and for feedback to be applied. Therefore, the position in which measurement is performed by the plasma temperature measuring section 60 and the like are not limited.

Figure 6:
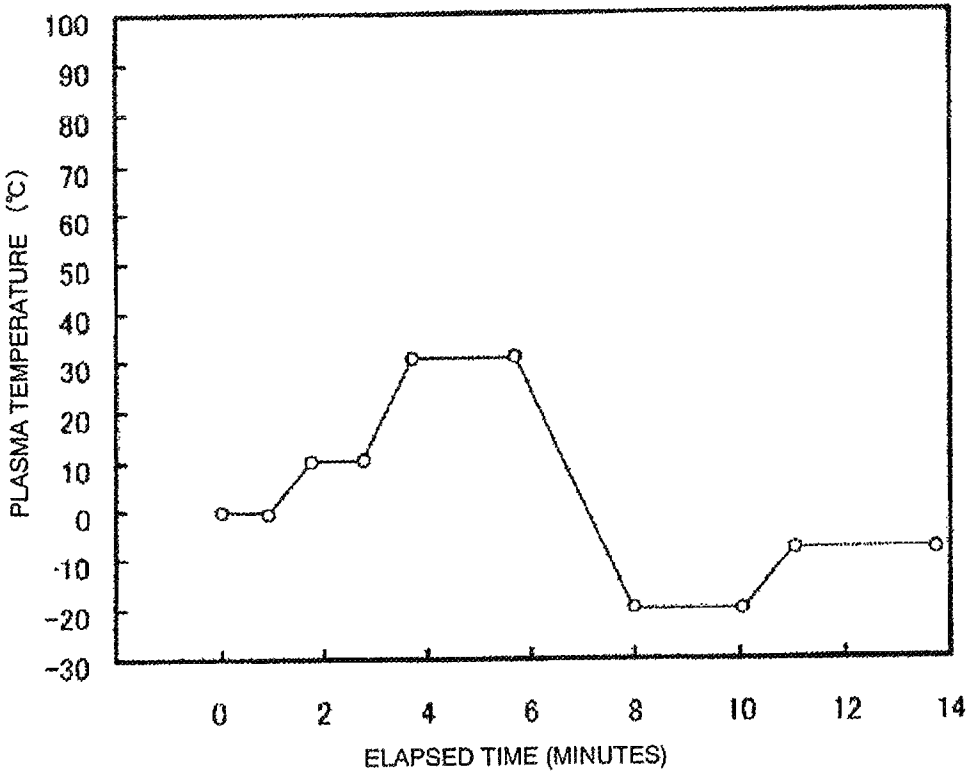
FIG. 6 is a control diagram of plasma temperatures achieved by the plasma temperature control apparatus in FIG. 5.

FIG. 6 shows a graph of the control of plasma temperature by the plasma temperature control apparatus 10 in FIG. 5. From FIG. 6, it is confirmed that the plasma temperature can be arbitrarily controlled by the plasma temperature control apparatus 10 according to the present embodiment.

Here, the temperature of the plasma generated by a typical corona-discharge or barrier-discharge plasma device is within a range of about 25° C. to 100° C. On the contrary, in the plasma temperature control apparatus 10 according to the present embodiment, the plasma temperature can be more accurately controlled over a wider temperature range of about −90° C. to 200° C. (temperature set by the melting point of a material that becomes a thigh-temperature section or the like).

As a result of the plasma temperature being controlled to an arbitrary temperature in this way, the possibility of the plasma temperature control apparatus 10 being used for numerous applications emerges. For example, as a result of the temperature of plasma becoming the same temperature as that of a human body, about 36.5° C., using the plasma temperature control apparatus and the plasma temperature control method according to the present embodiment, damage and load occurring during irradiation onto a human body can be reduced. Therefore, direct plasma irradiation to a human body becomes possible, and application to the medial dental fields is anticipated.

In addition, according to the present embodiment, in vapor Phase synthesis and surface treatment, because the plasma temperature can be controlled to a temperature optimal for the desired chemical reaction and catalyst reaction, various types of vapor phase synthesis and surface treatment can be performed. In addition, according to the present embodiment, in the surface treatment, as a result of the temperature of the irradiated plasma being controlled, the temperature of the treated object can be controlled, and the reaction speeds and treatment results can be controlled. In addition, although the gas temperature of plasma could not be controlled in conventional vapor phase synthesis, as a result of the gas temperature being controlled using the plasma temperature control apparatus and the plasma temperature control method according to the present embodiment, advantages can be gained in vapor phase synthesis in nano-particle manufacturing and the like.

According to the present embodiment, compared to the conventional plasma device, so-called high non-equilibrium plasma that has low gas temperature and high electron temperature can be generated. Furthermore, as a result of the gas temperature of plasma being controlled using the plasma temperature control apparatus and the plasma temperature control method according to the present embodiment, non-equilibrium of plasma can be controlled.

According to the present embodiment, a configuration is used in which the periphery or the interior of the gas pipe 12 and the plasma generating section 40 are filled with substance of the heat-insulating material 14 thereof. Therefore, heat-proofing effect can be improved, and abnormal discharge, power loss, high-frequency impedance changes, and the like attributed to deterioration of electrical insulating capacity caused by condensation and frost formation can be prevented. Furthermore, insulating properties of high-voltage sections can be increased, abnormal discharge can be avoided, and furthermore, the present invention is effective for miniaturizing devices.

The present invention is not limited only to the above-described embodiments. Constituent elements can be modified and specified in the implementation stage without departing from the spirit of the invention. In addition, through appropriate combination of the plurality of constituent elements disclosed in the above-described embodiments, various inventions can be formed. For example, some constituent elements may be eliminated from the overall constituent elements according to the embodiments. Furthermore, constituent elements over differing embodiments can be combined accordingly. In addition, various modifications can be made without departing from the spirit of the invention.

According to the above-described embodiments, the plasma temperature is more effectively controlled through use of a plasma generating device for use under atmospheric pressure and plasma generation performed under atmospheric pressure. However, depending on the intended application, a plasma generating device for use in a vacuum or for use under low pressure can be used, and the plasma temperature can be controlled under conditions from a vacuum to atmospheric pressure or more.

According to the above-described embodiments, the temperature of the plasma-generating gas is lowered by the plasma-generating gas passing via the gas pipe through the cooler filled with liquid nitrogen. However, other methods can be used. For example, the plasma-generating gas can be cooled by passing through other coolants, such as dry ice or ice water, or may be cooled using a refrigerator, a Peltier element, a heat-pump heat exchanger, or the like. In addition, the plasma-generating gas can be adiabatically expanded using an expander, a Joule-Thomson valve, or the like. Furthermore, instead of the plasma-generating gas being cooled, a liquid-state plasma-generating gas may be evaporated and subsequently supplied to a plasma gas supplying path or the plasma generating section. Alternatively, a liquid-state or solid-state plasma-generating gas may be directly supplied to the plasma gas supplying path or the plasma generating section.

The invention claimed is:

1. A plasma temperature control apparatus comprising:

a plasma generating section that turns a plasma-generating gas into plasma;

a plasma-generating gas temperature control section that controls a temperature of the plasma-generating gas, supplied to the plasma generating section, by allowing a single cooling section and a single heating section to cooperate with each other, the cooling section being provided in a supplying path that supplies the plasma-generating gas to the plasma generating section, and the heating section being provided on a downstream side of the cooling section in the supply path; and a temperature measuring section that measures a temperature of the plasma in the plasma generating section, wherein the temperature of the plasma measured by the temperature measuring section is fed back to the plasma-generating gas temperature control section, the plasma-generating gas is cooled by the cooling section, and the cooled plasma-generating gas is heated by the heating section, thus controlling the temperature of the plasma-generating gas, so that the temperature of the plasma generated in the plasma generating section is made lower than a temperature of plasma generated from a plasma-generating gas which is not controlled for temperature by the plasma-generating gas temperature control section.

2. A plasma temperature control apparatus comprising:

a plasma generating section that turns a plasma-generating gas into plasma; and a plasma-generating gas temperature control section that controls a temperature of the plasma-generating gas, supplied to the plasma generating section, by allowing a single cooling section and a single heating section to cooperate with each other, the cooling section being provided in a supplying path that supplies the plasma-generating gas to the plasma generating section, and the heating section being provided on a downstream side of the cooling section in the supply path; and a temperature measuring section that measures a temperature of the plasma in the plasma generating section, wherein the temperature of the plasma measured by the temperature measuring section is fed back to the plasma-generating gas temperature control section, the plasma-generating gas is cooled by the cooling section, and the cooled plasma-generating gas is heated by the heating section, thus controlling the temperature of the plasma-generating gas, so that the temperature of the plasma generated in the plasma generating section is made at room temperature or below.

3. A plasma temperature control apparatus comprising:

a plasma generating section that turns a plasma-generating gas into plasma; and a plasma-generating gas temperature control section that controls a temperature of the plasma-generating gas, supplied to the plasma generating section, by allowing a single cooling section and a single heating section to cooperate with each other, the cooling section being provided in a supplying path that supplies the plasma-generating gas to the plasma generating section, and the heating section being provided on a downstream side of the cooling section in the supply path; and a temperature measuring section that measures a temperature of the plasma in the plasma generating section, wherein the temperature of the plasma measured by the temperature measuring section is fed back to the plasma-generating gas temperature control section, the plasma-generating gas is cooled by the cooling section, and the cooled plasma-generating gas is heated by the heating section, thus controlling the temperature of the plasma-generating gas, so that the temperature of the plasma generated in the plasma generating section is made 0° C. or below.

4. A plasma temperature control method for controlling a temperature of plasma, comprising:

a plasma generating step of turning a plasma-generating gas into plasma;

a temperature measuring step of measuring a temperature of the plasma; and a plasma-generating gas temperature controlling step of cooling and then heating the plasma-generating gas supplied to the plasma generating step, wherein, while the temperature of the plasma is being measured in the temperature measuring step, by controlling, the temperature of the plasma-generating gas in the plasma-generating gas temperature controlling step, the temperature of the plasma generated in the plasma generating step is made lower than a temperature of plasma generated from a plasma-generating gas that is not controlled for temperature by the plasma-generating gas temperature control step.

5. A plasma temperature control method for controlling a temperature of plasma, comprising:

a plasma generating step of turning a plasma-generating gas into plasma;

a temperature measuring step of measuring a temperature of the plasma; and a plasma-generating gas temperature controlling step of cooling and then heating the plasma-generating gas supplied to the plasma generating step, wherein, while the temperature of the plasma is being measured in the temperature measuring step, by controlling the temperature of the plasma-generating gas in the plasma generating gas temperature controlling step, the temperature of the plasma generated in the plasma generating step is made at room temperature or below.

6. A plasma temperature control method for controlling a temperature of plasma, comprising:

a plasma generating step of turning a plasma-generating gas into plasma;

a temperature measuring step of measuring a temperature of the plasma; and a plasma-generating gas temperature controlling step of cooling and then heating the plasma-generating gas supplied to the plasma generating step, wherein, while the temperature of the plasma is being measured in the temperature measuring step, by controlling the temperature of the plasma-generating gas in the plasma generating gas temperature controlling step, the temperature of the plasma generated in the plasma generating step is made 0° C. or below.

* * * * *